US005090145A

United States Patent [19]

Chiang et al.

[11] Patent Number: 5,090,145

[45] Date of Patent: Feb. 25, 1992

[54] PHOTO-HANGING AND DISPLAY APPARATUS

[76] Inventors: Sai M. Chiang, 1755 Filbert, Apt. #10, San Francisco, Calif. 94123; Don Newman, 419 Rices Mill Rd., Wyncote, Pa. 19095

[21] Appl. No.: 306,432

[22] Filed: Feb. 3, 1989

Related U.S. Application Data

[63] Continuation-in-part of Ser. No. 163,438, Mar. 3, 1988, abandoned.

[51] Int. Cl.[5] ..... G09F 7/00

[52] U.S. Cl. ..... 40/605; 40/617

[58] Field of Search ..... 40/603, 604, 605, 617, 40/124.2

[56] References Cited

U.S. PATENT DOCUMENTS

| | | | |
|---|---|---|---|
| 703,394 | 7/1902 | Elam | 40/604 |
| 2,193,928 | 3/1940 | Johnson | 40/603 |
| 3,154,870 | 9/1962 | Hopp et al. | 40/604 |
| 3,217,690 | 6/1964 | Mihalisin | 116/173 |
| 3,310,899 | 3/1967 | Hart et al. | 40/604 |
| 3,537,201 | 11/1970 | Huey et al. | 40/604 |
| 3,763,585 | 10/1973 | Mosgh | 40/604 |
| 3,885,335 | 5/1975 | Egermayer | 40/603 |
| 4,176,480 | 12/1979 | Euzarraga et al. | 40/155 |
| 4,525,946 | 7/1985 | Olson | 40/514 |
| 4,722,146 | 2/1988 | Kemeny | 40/605 |
| 4,882,866 | 11/1989 | Gebhardt | 40/617 |
| 4,890,403 | 1/1990 | Dinan | 40/604 |

FOREIGN PATENT DOCUMENTS

| | | | |
|---|---|---|---|
| 330502 | 8/1989 | European Pat. Off. | 40/605 |
| 2226681 | 7/1990 | United Kingdom | 40/605 |

*Primary Examiner*—John G. Weiss
*Assistant Examiner*—Michael Lynch
*Attorney, Agent, or Firm*—Seidel, Gonda, Lavorgna & Monaco

[57] ABSTRACT

Photo hanging and display apparatus including an upper rod-like member 10 having specially configured slots 24 and 26 running along the top and bottom portions thereof, hanging members 20 and 22 including wires or cables 38 with attachment loops affixed to one end and a slot engaging clip 36 attached to the other for engaging the upper slot 24 of the upper rod. Flexible strips 50 and 54 of edging material are provided for attachment to the upper edge of the sheet 16 (18) to be hung, the edging strips being configured to mate with and slide into the lower slot 26 of the upper member 10. An elongated lower rod-like member 12 also has a specifically configured slot 62 formed in its upper surface which is adapted to receive engaging strips 60 affixed to the lower edge of the sheet (18). Alternatively, a plurality of sheets (16 and 18) may be coupled together using an intermediate rod-like member 14 (80, 90) having multiple slots formed in its surfaces for engaging strips attached to the upper and lower edges of adjacent sheets. Decorative end caps (30, 32, 72, 74) are also provided for the rods.

23 Claims, 6 Drawing Sheets

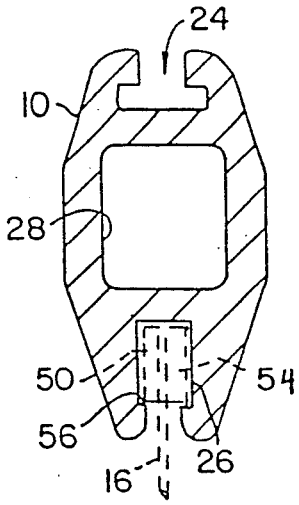
FIG. 2
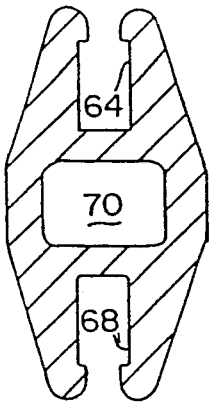
FIG. 4
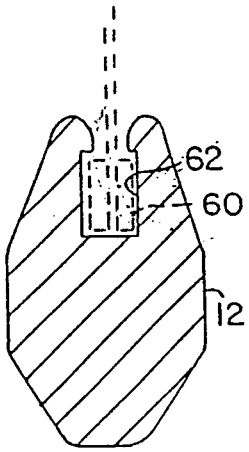
FIG. 3
FIG. 5
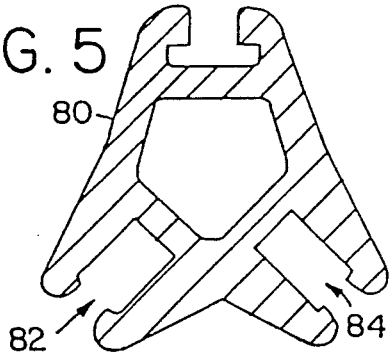
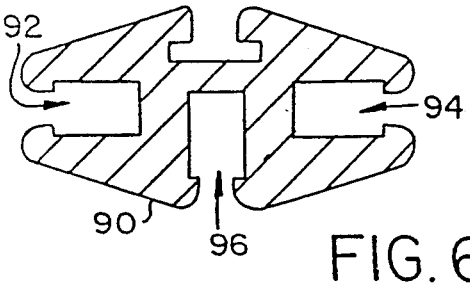
FIG. 6
FIG. 7
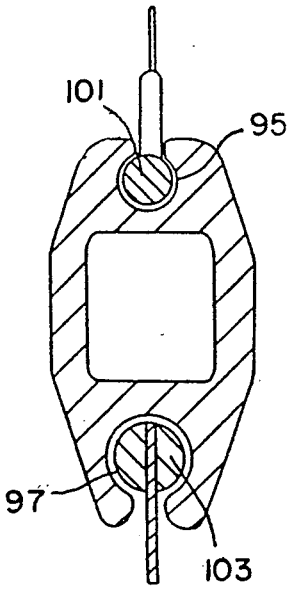
FIG. 8
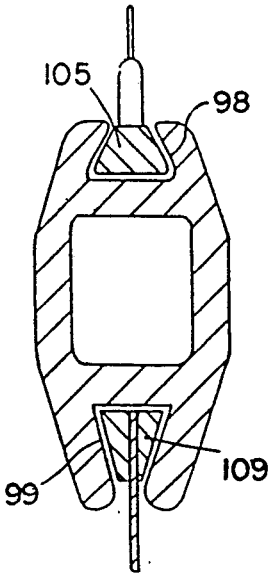

FIG. 12
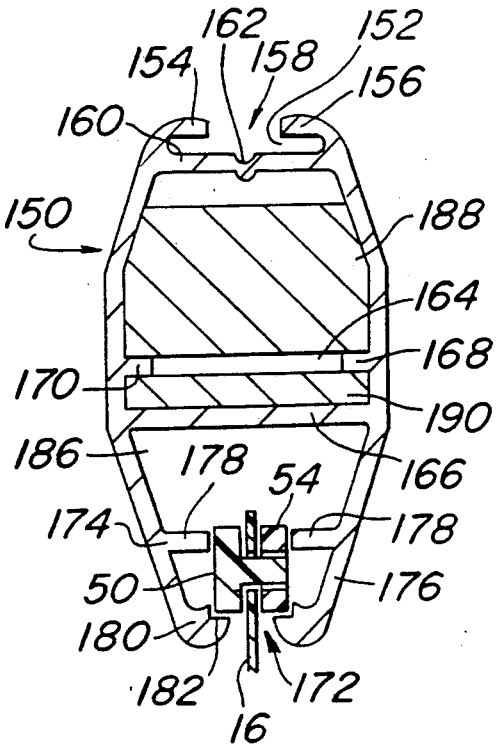
FIG. 13
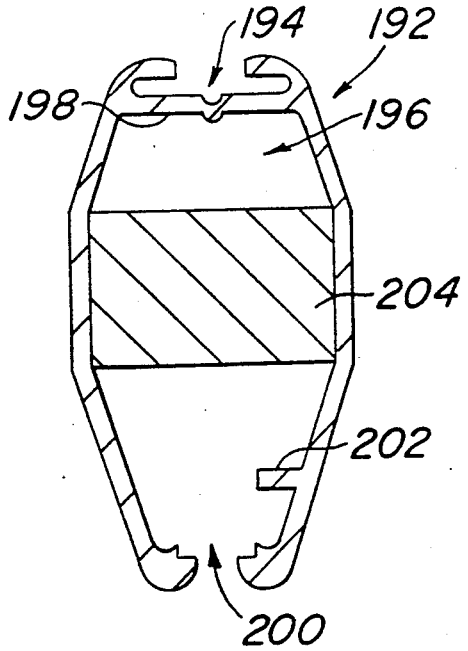
FIG. 15
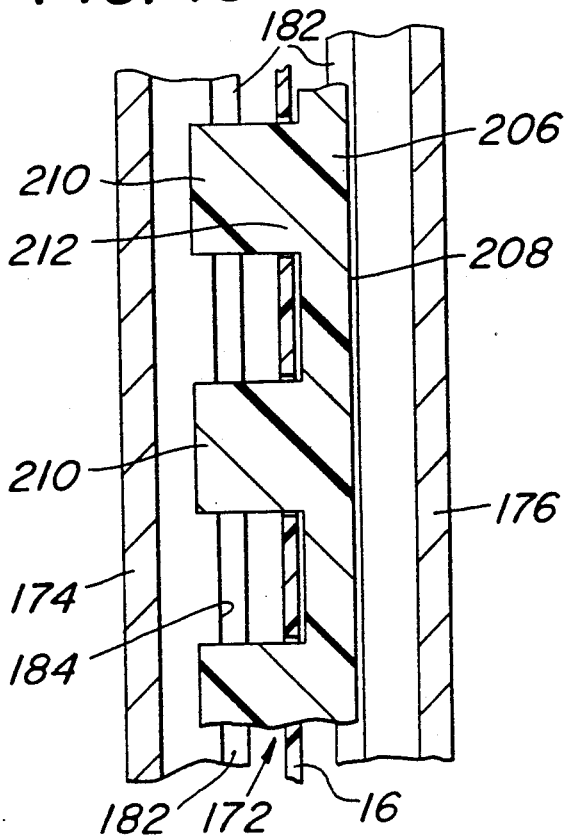
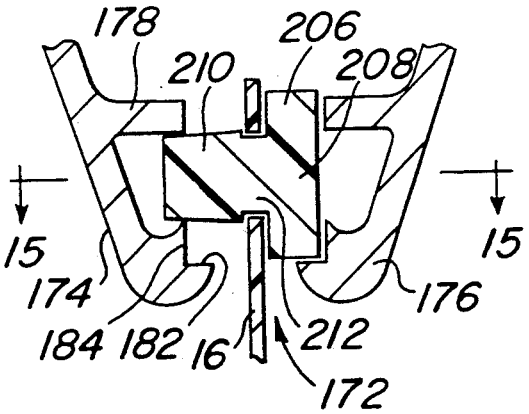
FIG. 14

FIG. 16
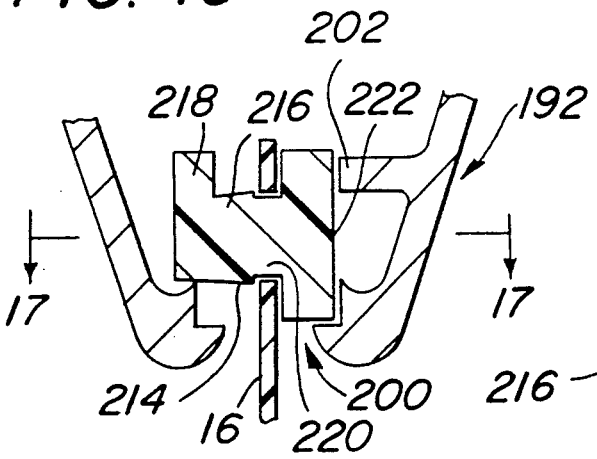
FIG. 17
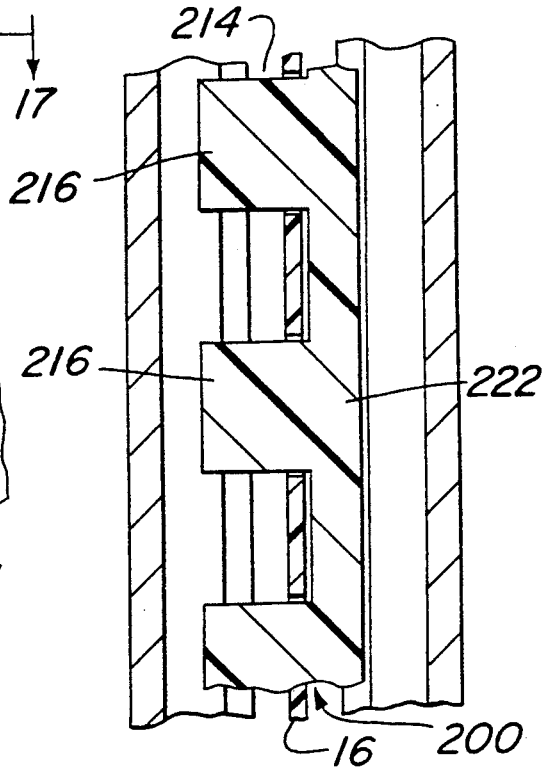
FIG. 19
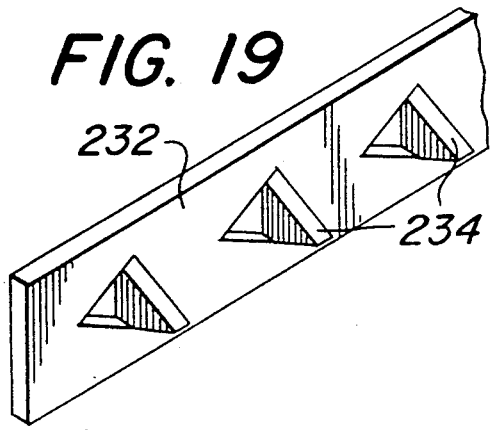
FIG. 18
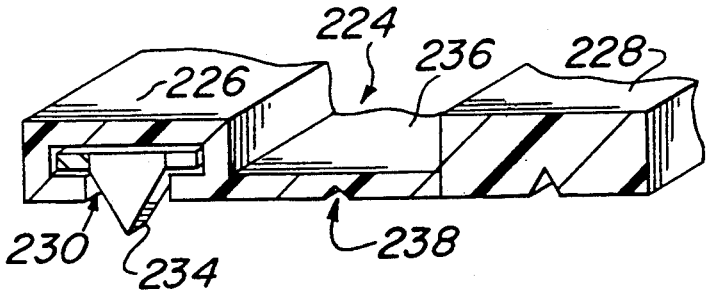
FIG. 21
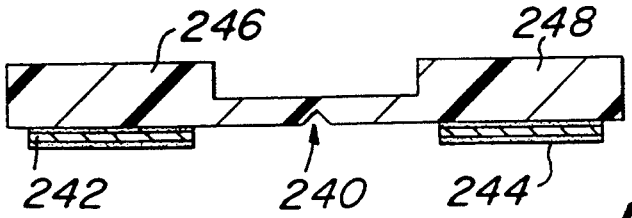
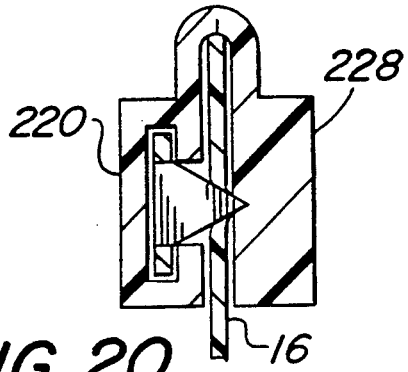
FIG. 20

PHOTO-HANGING AND DISPLAY APPARATUS

PRIOR APPLICATION

This is a continuation-in-part of application Ser. No. 07/163,438 filed Mar. 3, 1988, now abandoned.

BACKGROUND OF THE INVENTION

1. Field of the Invention

The present invention relates generally to display hanging apparatus, and more particularly to a novel set of rod-like members and associated appliances for hanging flexible sheets of material such as large photos in any of a wide variety of display orientations.

2. Description of the Prior Art

Scrolls, calendars, wall hangings, tapestries and many other similar articles have long been displayed by attaching upper and lower edges to elongated rods, tubes or the like made of wood or various metals so that the article can be hung from a ceiling or a wall. The rods are typically rigid and serve the purpose of providing means for maintaining one or more edges of the sheet material in a planar configuration. Typically, the edge was glued or stapled to the surface of the rod or wrapped thereabout and attached to itself. In most cases, the edge engaging rods were permanently affixed to the sheet. This meant that the rods and associated hanging hardware were either not reusable upon discard of the sheet material or required refurbishing prior to reuse. In addition, where the rods were permanently affixed to the sheet material, shipping of the product from one point to another was somewhat difficult and awkward in that the material would have to be wrapped about at least one of the rods with the other forming the tail of the roll. This made packaging inefficient.

With the advent of more rugged plastic and plastic-like sheet materials including photographic sheets such as those made by Kodak, it has become practical to use very large photographic wall hangings for artistic, decorative or promotional displays. However, to date, no one has addressed the problem of providing an efficient, easy to install and use a hanging system for use of such applications.

SUMMARY OF THE PRESENT INVENTION

It is therefore a principal object of the present invention to provide a novel hanging system including several components which can be combined in selected arrangements to provide various types of hanging displays.

Another object of the present invention is to provide an inexpensive means for hanging poster type displays without requiring use of staples or other means for attaching the sheet material to the hanging structure.

Still another object of the present invention is to provide a plurality of related component parts which can be mated to one or more pieces of sheet material to provide a hanging display of virtually unlimited size and configuration.

Briefly, one preferred embodiment of the present invention includes an upper rod-like member having specially configured slots running along the top and bottom portions thereof, hanging means including wires or cables with attachment loops affixed to one end, and slot engaging clip means attached to the other for engaging the upper slot of the upper rod. Flexible strips of edging material are provided for attachment to the upper edge of the sheet to be hung, the edging strips being configured to mate with and slide into the lower slot of the upper bar. An elongated lower rod-like member also has a specially configured slot formed in its upper surface which is adapted to receive edging strips affixed to the lower edge of the sheet. Alternatively, a plurality of sheets may be coupled together using an intermediate rod-like member having multiple slots formed in its surfaces for engaging edging strips attached to the upper and lower edges of adjacent sheets. Decorative end caps are also provided for the rods.

Among the many advantages of the present invention are that it is reusable, may be used to hang any type of sheet material and may be shipped or stored in disassembled form for assembly at the hanging site.

Another advantage of the present invention is that it provides a relatively inexpensive means of hanging sheet material in a wide variety of configurations.

These and other objects and advantages of the present invention will no doubt become apparent to those of ordinary skill in the art after having read the following detailed description of the preferred embodiments which are shown in the several figures of the drawing.

BRIEF DESCRIPTION OF THE DRAWINGS

FIG. 2 is a transverse cross-section taken through the upper rod depicted in FIG. 1;

FIG. 3 is a transverse cross-section taken through the lower rod depicted in FIG. 1;

FIG. 4 is a transverse cross-section taken through the intermediate rod depicted in FIG. 1;

FIGS. 5 and 6 are transverse cross-sections taken through alternative rod embodiments for hanging sheet material in other than vertical disposition;

FIGS. 7 and 8 are transverse cross sections taken through alternative rod embodiments;

FIG. 12 is a transverse cross-section of an alternate embodiment of the present invention;

FIG. 13 is a transverse cross-section of a further alternate embodiment of the present invention;

FIG. 14 is an enlarged view of a portion of the embodiment shown in FIG. 12 also showing an alternate embodiment of a sheet hanging strip portion of the present invention;

FIG. 15 is a cross-section taken along line 15—15 in FIG. 14;

FIG. 16 is an enlarged view of a portion of the embodiment shown in FIG. 13 also showing an alternate embodiment of the sheet hanging strip portion of the present invention;

FIG. 17 is a cross-section taken along line 17—17 in FIG. 16;

FIG. 18 is a cross-sectional view of a further alternate embodiment of the sheet hanging strip portion of the present invention;

FIG. 19 shows a portion of the embodiment illustrated in FIG. 18;

FIG. 20 is an assembled cross-sectional view of the embodiment of the sheet hanging strip illustrated in FIG. 18; and FIG. 21 is another alternate embodiment of a sheet hanging strip portion of the present invention.

DETAILED DESCRIPTION OF THE PREFERRED EMBODIMENTS

Figure 1:
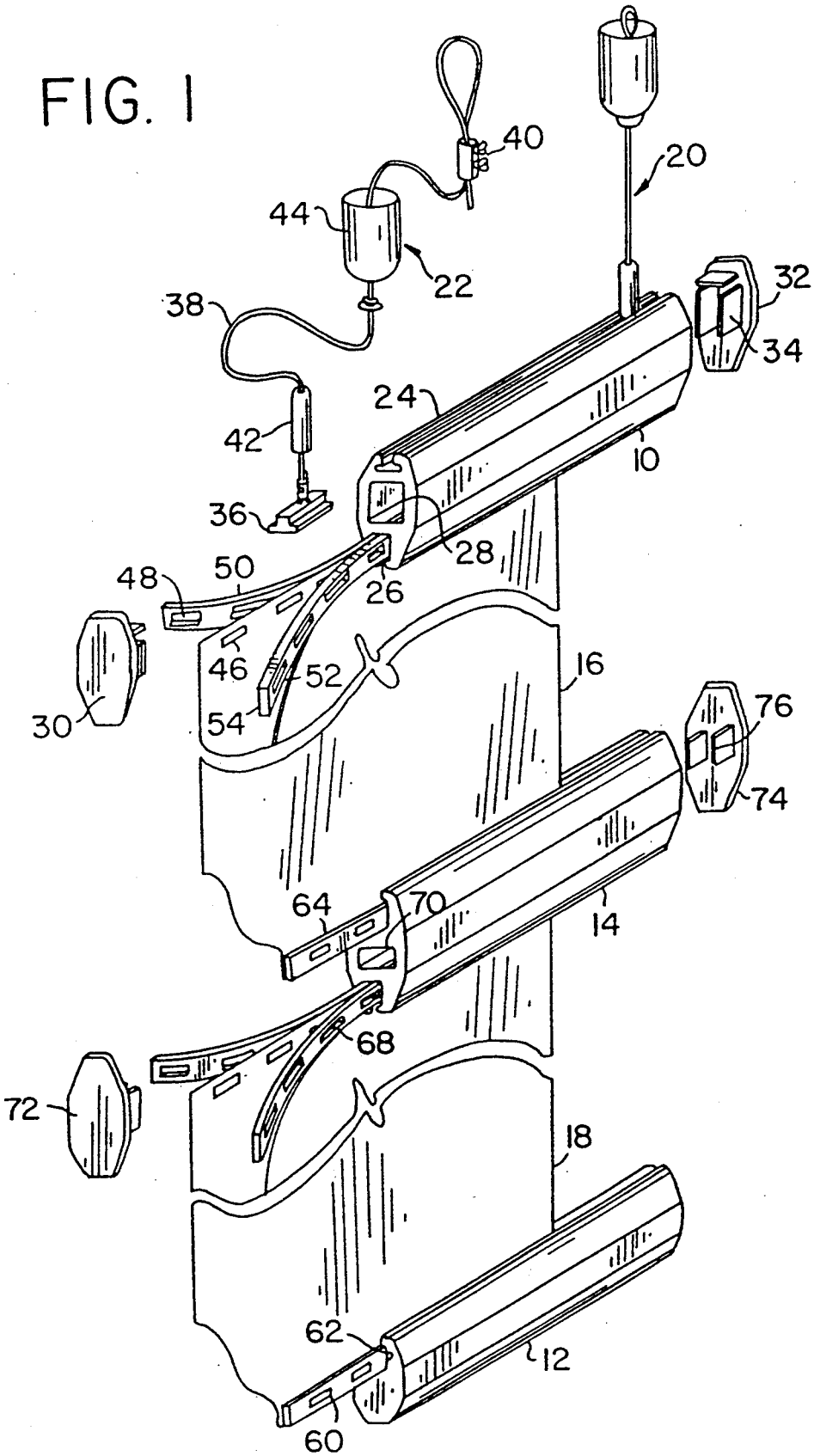
FIG. 1 is a partially broken and exploded isometric view illustrating a presently preferred embodiment of the present invention.

Referring now to FIG. 1 of the drawings, there is shown in partially broken and exploded isometric view a presently preferred embodiment of the present invention, including an upper rod 10, a lower rod 12 and an intermediate rod 14, shown hanging two pieces of sheet material 16 and 18 which could take the form of photographs, canvas sheets of colored paper or plastic or any other suitable material. Rod 10 is suspended from hangers shown assembled at 20 and in disassembled form at 22.

As further evidenced by the cross-section shown in FIG. 2 of the drawing, rod 10 is preferably a metal or plastic extrusion having an inverted T-shaped slot 24 formed in its upper portion and extending along the entire length thereof. A generally rectangular second slot 26 open at the bottom is provided in the lower portion of the rod as illustrated. In order to conserve material and reduce weight, a generally rectangular central opening 28 extends along the entire length of rod 10. Furthermore, in order to improve the aesthetic appearance, the exterior surface of rod 10 is bevelled to form several facets.

As indicated at 30 and 32, end caps may be provided having outwardly extending tabs 34 which are adapted to be inserted into the open ends of the opening 28 and to frictionally engage the inner walls thereof to hold the caps 30 and 32 in place. Note that the outer perimeters of the caps are configured to conform to the facetted surface of rod 10.

Hangers 20 and 22 are each comprised of an elongated slider bracket 36 that is generally T-shaped in cross-section and is adapted to slide into the slot 24 from the ends of rod 10 before the end caps are installed. A wire (or cable) 38 has one end attached to the upper portion of slider 36, and the other end looped and clamped to itself by a suitable clamping fixture 40. A ferrule 42 conceals the attachment of wire 38 to slider 36, and a cup shaped sleeve 44 is provided at the upper end of wire 38 to cover the end loop and clamp 40.

In order to affix the sheet material 16 to rod 10, rectangular holes 46 are punched along the upper edge thereof for receiving the tabs 48 of the plastic strip 50. After passing through the opening 46 the tabs 48 are inserted into corresponding openings 52 in a second strip 54 sandwiching the edge of sheet 16 therebetween. The resulting edge assembly is then slid into the passageway 26 with sheet 16 extending through the slotted opening at the bottom. Note that as is more clearly shown in FIG. 2, the strips 50 and 54, when combined with the thickness of sheet 16, form an assembly having an outside dimension slightly less than that of the slot 26. As indicated in FIG. 2 the assembly is retained within slot 26 by its interference with shoulders 56 formed at the bottom of the lower opening.

In the case of a single sheet to be hung in accordance with the present invention, the bottom edge thereof would be similarly punched and engaged to a pair of plastic strips as indicated at 60. The assembly 60 would then be inserted into an elongated rectangular slot 62 formed in the top portion of a solid rod 12. As is suggested in FIG. 3 of the drawing, rod 12 is made solid in order to provide sufficient weight to overcome any tendency of the hanging sheet to roll as a result of its having been previously rolled for shipping or storage.

Where two sheets are to be hung as a unit, an intermediate rod, such as is shown at 14, is utilized. In this case, both upper and lower portions of bar 14 are provided with slotted openings similar to slot 26 of bar 10 and slot 62 of bar 12, and such slots are adapted to receive plastic strip assemblies 64 and 68 which are mated thereto in the same manner as in the case of bars 10 and 12. Note that in order to save material and reduce weight and cost, a rectangular hollow 70 is formed in the middle of bar 14 during its extrusion. As in the case of bar 10, end caps 72 and 74 having wall engaging tabs 76 are mated to the ends of rod 14.

As one can readily see, once the openings 46 are provided in the upper and lower edges of sheets 60 and 18, no tools are normally required to assemble and hang the assemblage for display. This of course means that the several parts of the assembly can be efficiently packaged, and even shipped in separate containers if that is desired.

In FIGS. 5 and 6 of the drawing, cross-sections of modified hanging rods are shown at 80 and 90 for accommodating other than vertically hung sheets. Aside from the external configuration, the only differences between these embodiments and those shown in FIGS. 2 and 4 are that multiple lower hanging slots are provided. More specifically, in the embodiment of FIG. 5, two hanging slots 82 and 84 are angled at approximately 45 degrees relative to horizontal. In the alternative embodiment shown in FIG. 6, two laterally extending slots 92 and 94 are provided in combination with a vertically extending slot 96. Use of these alternatives will be discussed below.

In FIGS. 7 and 8, two alternative slot configurations are depicted. As suggested in FIG. 7, instead of the T-shaped top and rectangularly shaped bottom slots, round or oval slots 100 and 102 may be used, or as illustrated in FIG. 8, triangular or trapezoidal configured slots 104 and 108 may be used. Note however, that the shapes of sliders 101 and 105 as well as strips 103 and 109 must also be modified to insure proper fit and engagement.

Figure 9:
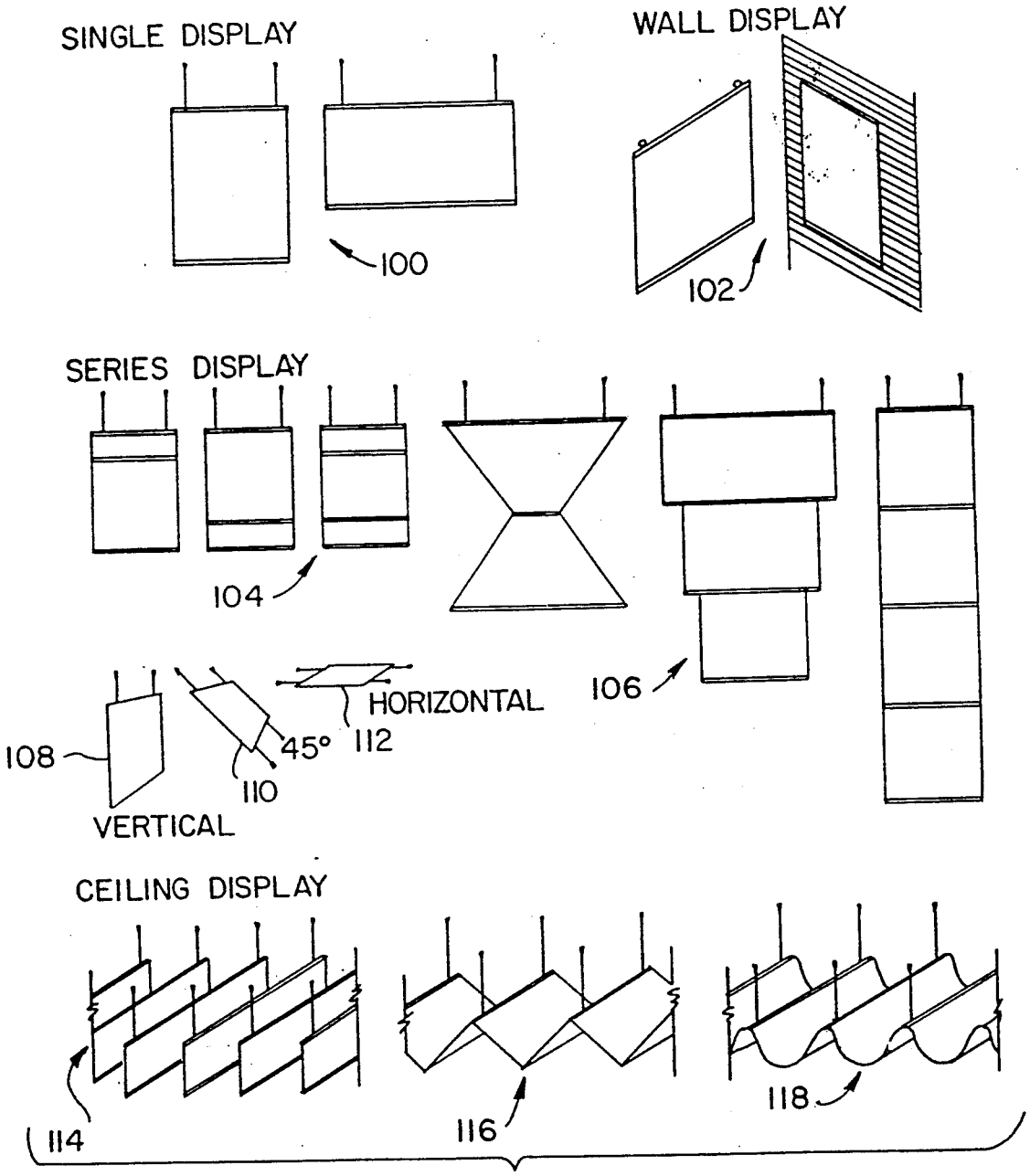
FIG. 9 is a diagram illustrating use of the present invention to hang sheet material in various combinations and orientation.

Turning now FIG. 9, various forms of use of the present invention are suggested. Single sheet vertical displays are illustrated at 100 and similar wall displays are shown at 102, the principal difference between the two being the configuration of the hanger mechanism and its engagement with either the slider 36 or the rod 10.

Multiple panel displays are shown at 104 and 106, and various angled hangings at vertical, inclined and horizontal are shown at 108, 110 and 112 respectively. Ceiling displays including multiple panels hung individually or jointly are illustrated at 114, 116 and 118, with the hanger rod embodiment of FIG. 5 being utilized in the display indicated at 116, and the embodiment of FIG. 6 being utilized in the display illustrated at 118.

Figure 10:
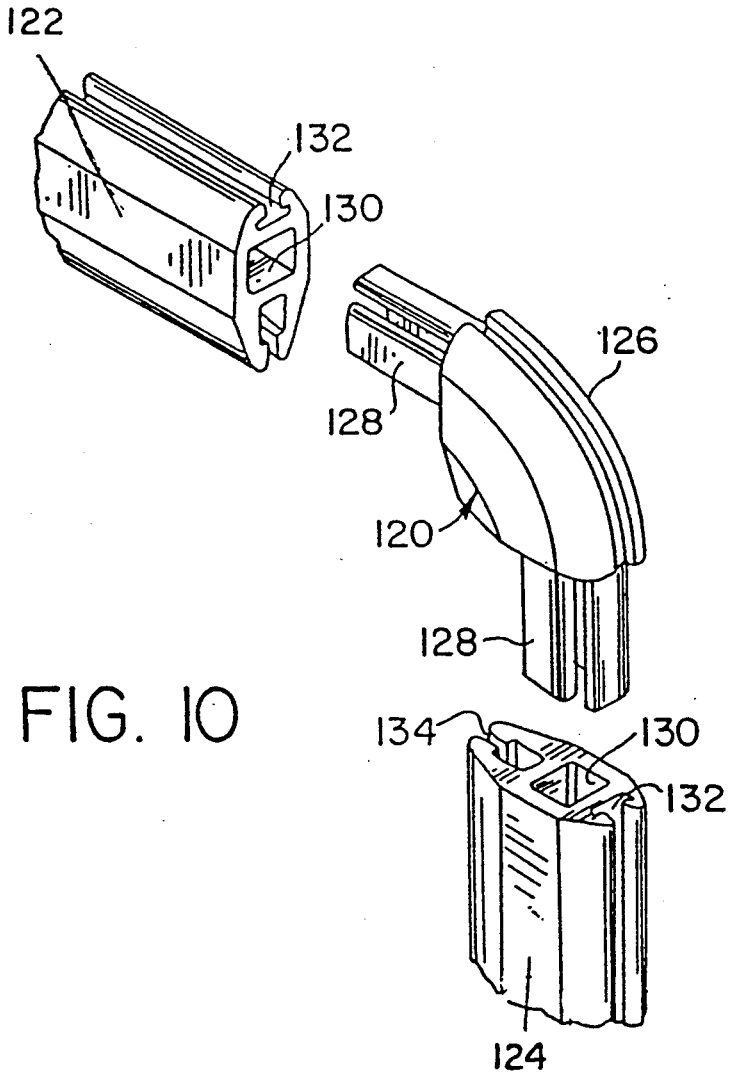
FIG. 10 is a broken and exploded isometric view illustrating a side rod and corner cap for use in accordance with the present invention.

In FIG. 10 a corner connector 120 is illustrated for connecting two rods 122 and 124 of the type used to form the upper rod 10 shown in FIG. 1. Connector 120 includes a corner forming body portion 126 the exterior surface of which is configured to match the facetted surfaces of the rods 120 and 124. The body portion can be curved as illustrated or can be squared to give the impression of intersecting rods. Extending from each of the rod engaging faces are three fastening tabs 128, two of which slide into the openings 130, with the third tab being insertable in the T-shaped slots 132.

It will be appreciated that if instead of using a lower rod of the type shown at 12 in FIG. 1, one uses a rod of the type shown at 10 for the lower rod, and then uses two additional rods of the same type along with four of the corner connectors 120, a complete four sided frame can be fabricated. In the usual case edging strips of the type depicted at 48 and 50 in FIG. 1 would be attached to the upper and lower edges of the sheet to be mounted, and after such edges were mated to the upper and lower rods, a pair of side rods would be attached to the assembly using corner connectors 126. The length of the side rods are selected so as to impart a slight stretching force to the upper and lower rods and thereby hold the sheet taut. In the usual case the sheet would be sized so that the side edges would extend slightly into the slots 134 in the side rods to give the appearance of all around attachment.

Figure 11:
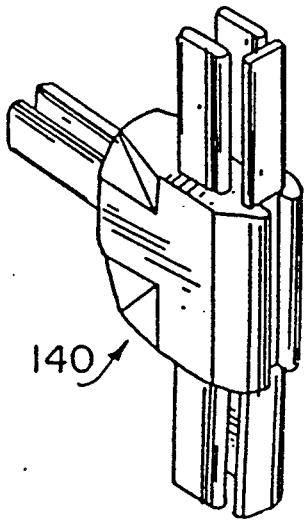
FIG. 11 is an isometric view illustrating an intermediate rod to side rod connector in accordance with the present invention.

For similar applications wherein it is desired to mount multiple sheets, intermediate rods 14 (FIG. would be used and connectors 140 such as illustrated in FIG. 11 would be used to join the intermediate bars to the side bars.

FIG. 12 shows an alternate embodiment of a rod 150. At the upper end of rod 150 is provided an inverted T-shaped slot 152. Slot 152 is generally formed by flanges 154 and 156 which project inwardly towards gap 158. The bottom of the inverted slot 152 is formed by crossing member 160 which extends between opposite sides of the rod 150. Provided within the center of crossing member 160 is depression 162. Depression 162 preferably runs the length of the gap 158 formed by the T-shaped slot 152 and thus the length of rod 150. The purpose of depression 162 is to accommodate for minor variations in dimensions of slider brackets 36, as illustrated in FIG. 1. Furthermore, slider brackets 36 may be provided with small projection or teats on its lower surface (not shown). These projections would preferably be easily sheared upon admission into the gap so as to provide a tight fitting relationship between the slider bracket 36 and the internal surfaces of the slot 152.

Positioned below the crossing member 160 is an opening 164 defined by the side walls of rod 150, crossing member 160 and central crossing member 166. Projecting into the opening 164 from the side walls of rod 150 are tabs 168 and 170. The purpose of these tabs will be discussed further in detail below.

The lower portion of rod 150 includes a support gap 172 for receiving a strip assembly, such as that illustrated in FIG. 1 formed by a first strip 50 and second strip 54. The support gap 172 is formed by projecting claws 174, 176. In the embodiment shown in FIG. 12, claws 174 and 176 are substantially the same in structure except being mirror images of one another. The formation of claw 174 will be described hereinafter as representative of both structures.

Claw 174 includes flange 180 having a support shoulder 182 and a vertically-projecting stabilizing surface 184. As can be seen, the strip assembly 50, 54 has a generally-rectangular cross-section when tab 48 on the first strip 50 which is projected through rectangular hole 46 within the sheet 16 and mates with openings 52 within the second strip 54. The strip assembly 50, 54 is positioned within the support gap 172, is supported vertically by the support shoulder 182 and is prevented from moving laterally within the gap 172 by vertical surface 184. The upper end of the strip assembly 50, 54 is maintained with the gap 172 by means of tabs 178. Tab 178 extends into gap 172 so as to substantially align vertically with surface 184 of the claw 174.

In this embodiment, the support gap 172 communicates and forms a part of open area 186. The lack of a top surface for gap 172, contrasted with the rectangular slot 26 in FIG. 2, permits the strip assembly 50, 54 to be positioned within the gap 172 while permitting the top edge of the sheet 16 to project above the gap 172 without enlarging the dimensions thereof. It is contemplated that the amount of material between the rectangular slots 46 in sheet 16 and its upper edge would vary depending on the load and size of the sheet to be supported by rod 150. Similar size rods may be utilized for any size sheet as can similar dimensional strips. However, the spacing between the opening and the edge would vary depending on the structural requirements of the sheet. Therefore, in order to accommodate the different distances between the holes 46 and the edge of sheet 16, the opening above support gap 172, 200 is provided.

In the embodiment shown in FIG. 12, it is contemplated that the rod 150 be made by extrusion of an aluminum or other lightweight relatively stiff material. Since the cost of the raw aluminum material is relatively high, a reduction in the amount of material to be used is preferred. Therefore, the embodiment FIG. 12 has been specifically designed to substantially reduce the overall weight of the rod 150, and thus the amount of aluminum used, as compared to the embodiments illustrated in FIGS. 2–9. However, due to this substantial weight reduction of the rod, it may be desirable to provide additional weight within the rod acting as the bottom hanger for the sheet 16. This additional weight would maintain the sheet 16 in a taut condition. Therefore, if additional weight is desired, prefabricated weights 188 or 190 may be provided within the opening 164. Weight 188 is generally positioned within the opening 164 and supported on its lower edge by tabs 170 and 168. Weight 190, which may be an alternate form of providing additional weight to the rod 150, as compared to weight 188 or used in conjunction therewith, comprises a generally-rectangular bar. Weight 190 is positioned within the opening 164 below tabs 168 and 170 and supported on its lower surface by central crossing member 166. Weights 188, 190 may take an elongated form that will be inserted into rod 150 so as to extend substantially along the entire length of the rod 150, or may be individual members which may be positioned at various locations along the length. Weights 188, 190 may be made of steel or molded and filled so as to fit within the contours of opening 164.

FIG. 13 shows another alternate embodiment of a rod 192 also providing a material reduction. As an example, the rod 26 illustrated in FIG. 2 typically has an extruded weight of approximately 0.47 pounds per foot. The embodiment illustrated in FIG. 12, exclusive of the additional weights 188, 190, typically has a weight of 0.2 pounds per foot for the same external dimensions. The embodiment illustrated in FIG. 13 further reduces the weight to 0.15 pounds per foot, i.e., reducing the amount of material another 25 percent.

Rod 192 generally includes a T-shaped slot 194 which, as illustrated, is substantially the same as slot 152. Opening 196 within rod 192 is substantially continuous from the cross member 198 to support gap 200 at the bottom edge thereof. In the embodiment illustrated in FIGS. 12 and 13, a support gap or opening may also be provided in the upper end of the rod, replacing the T-shaped slot, such that the rod acts as an intermediate rod similar to rod 14 illustrated in FIG. 1. Furthermore, the T-shaped slot may be omitted completely to form a bottom rod.

The support gap 200 within the rod 192 has generally the same form as support gap 172, excluding one tab 178. Weight 204 may also be provided within the opening 196. Weight 204 may take any form as desired and may be contoured so as to maintain its position within the cross-sectional dimensions of opening 196.

FIG. 14 shows an alternate embodiment of a strip assembly 206 for attachment to the edges of sheet 16. Strip 206 is formed so as to be positioned within either support gap 172 or 200 of the embodiments illustrated in FIG. 12 or 13, but may also be dimensioned to be stably supported within the other embodiments of the rods discussed above. Support strip 202 includes a continuous generally-rectangular portion 208 and a projecting portion having a triangular frustum cross-section. Connecting portion 212 between portion 208 and portion 210 has a width which is smaller in dimension than the base of the triangular frustum. Projecting portion 210 may be inserted into the rectangular holes 46 in sheet 16. It is contemplated that the holes 46 are slightly larger than the cross-sectional dimension of the connecting portion 212, yet smaller in dimension than the base of frustum portion 210. Thus, sheet 16 is slightly deformed when placed on strip 206 over portion 210 and rests on connecting portion 212. Strip 202 supports sheet 16 without requiring mating sections. Support gap 172 and strip 206 are formed such that the internal surfaces of support gap 172 maintains the strip 206 resting on shoulder 182 of claw 176. The lower portion of frustum 210 rests on the upper edge of surface 184 on claw 174. It is contemplated that the embodiment illustrated in FIG. 14 would also be capable of being supported within the rod 192 as illustrated in FIG. 13.

FIG. 16 illustrates an alternate embodiment of a support strip 214 which is a variation of that illustrated in FIGS. 14 and 15. The frustum portion 216 includes a projecting tab 218 at the end thereof. Thus, a sheet 16 may be inserted over tabs 218 through holes 46 and supported on the end of frustum 216 while each individual portion of the sheet is snapped over the base thereof onto connection portion 220. Since projecting tab 218 may interfere with the tab 178 at the top of support gap 172 on rod 150, rod 192 does not include a second tab 178.

As illustrated in FIGS. 18–20 illustrate an alternate embodiment of a strip assembly 224. Assembly 224 includes a preformed strip having a male side 226 and a female side 228. Male side 226 includes a T-shaped slot 230 within one surface. Slot 230 is adapted to receive strip 232 having a series of projecting points 234 formed therein. Strip 232 is contemplated to be a metal material with points 234 formed by stamping out a projection bent forward to extend from its surface. Strip 232 is slipped into the end of the T-shaped slot 230. Tabs 234 project outwardly from the gap formed by the slot 230. Male side 226 is connected to female side 228 by connecting flange 236.

It is contemplated that strip assembly 224 be made of a generally-resilient material so as to permit folding of the assembly 224 around the sheet material 16. A notch 238 is provided within the flange 236 to further assist this bending action. Notch 238 also provides an abutment surface for the edge of the sheet 16 so as to align the strip 224 substantially parallel along the edge of a sheet 16. Upon folding or pivoting about notch 238, points 234 project through the sheet material. Female side 228 receives the point 234 to maintain the strip 224 about the edge of the sheet 16. Thus sheet 16 does not typically require rectangular holes as in the embodiments discussed above.

An alternate embodiment of the strip assembly 240 is also illustrated in FIG. 21. Strip 240 includes a double-sided adhesive 242 and 244 on the respective male and female sides 246, 248 of the strip 240 to engage the opposite sides of the sheet 16 without requiring holes 46 or perforations therein.

As is readily apparent from the above, the present invention provides an almost unlimited choice of mix and match combinations with the principal variables being the type and shape of sheet material, the desired hanging characteristics, the type of hanger subassembly, and the length of rod stock. It will of course be appreciated that the rods and end caps can be configured in a wide variety of shapes and colors, and various materials can be used for their construction. It is thus anticipated that numerous alterations and modifications of the preferred embodiments illustrated above will become apparent to those of ordinary skill in the art after having read the above disclosure. It is therefore intended that the appended claims be interpreted as covering all such alterations and modifications as fall within the true spirit and scope of the invention.

We claim:

1. A hanger assembly for hanging a sheet of material comprising: an elongated upper rod, the upper rod having a first slot formed in a lower portion thereof and extending along substantially its entire length, said first slot having a transverse internal width wider than the width at its opening; mating means formed in an upper portion of the upper rod means, said mating means adapted to receive means for hanging said upper rod; an elongated lower rod means having a second slot formed in its upper surface and extending substantially along its entire length, said second slot having a transverse internal width greater than the width at its opening and having dimensions substantially the same as those of the first slot; and strip means having a first portion and a second portion adapted for releasable engagement with one another on opposite sides of the sheet of material and to engage an edge of the sheet, said strip means having a generally rectangular cross-section upon engagement between the first and second portions, the first and second slots adapted to conform and support the strip means, said sheet being thereby attached to and extending between said first and second rods.

2. A hanger assembly for hanging sheet material as recited in claim 1 wherein said mating means includes a third slot formed along its upper portion, said third slot having a generally inverted T-shaped cross-section and further comprising means for hanging said upper rod, said hanging means comprising slider means having a T-shaped cross-section adapted to be slideably received within said T-shaped third slot.

3. A hanger assembly for hanging sheet material as recited in claim 2 and further including a third rod having fourth and fifth slots respectively formed in the upper and lower portions thereof, said fourth and fifth slots having transverse internal dimensions larger than the width of their openings and having substantially the same dimensions as said first and second slots, said third rod adapted to be connected to the lower edge of a first sheet suspended from said upper rod from said first slot and connected to a second sheet extending therefrom to the to the lower rod, the lower rod suspended from said second sheet by connection with said second slot.

4. A hanger assembly for hanging sheet material as recited in claim 3 further comprising upper and lower left and right side rods; corner connectors having fastener means for engaging the ends of said upper and lower rods and fastening them to one end of said side rods; and intermediate connectors having fastener means for engaging the ends of said third rod and fastening them to the other ends of said side rods.

5. A hanger assembly for hanging sheet material as recited in claim 2 wherein said upper rod includes a plurality of said first slots each adapted to slideably receive strip means attached to the edge of a sheet to be hung.

6. A hanger assembly for hanging sheet material as recited in claim 5 where said plurality of first slots include two slots which respectively open to each side vertically and are angularly oriented relative thereto to slideably receives trip means attached to the edges of two sheets to be hung.

7. A hanger assembly for hanging sheet material as recited in claim 1 wherein said upper rod includes a plurality of said first slots each adapted to slideably receive strip means attached to the edge of a sheet to be hung.

8. A hanger assembly for hanging sheet material as recited in claim 7 where said plurality of first slots include two slots which respectively open to each side vertically and are angularly oriented relative thereto to slideably receive strip means attached to the edges of two sheets to be hung.

9. A hanger assembly for hanging sheet material as recited in claim 8 wherein said plurality of first slots further include an additional slot disposed between said two slots and opening downwardly to slideably receive strip means attached to a third sheet to be hung.

10. A hanger assembly for hanging sheet material as recited in claim 1 further comprising left and right side rods and corner connectors having fastener means for engaging the ends of said upper, lower and side rods to fasten them together in a frame-like configuration.

11. In a hanger assembly for hanging a sheet of material, the assembly having a plurality of elongated rods, means for suspending one of said rods, strip means for engaging the edge of the sheet of material and for sliding engagement by the rods, the sheet of material hanging between a first and second rod, the rods comprising: at least one slot extending longitudinally along the entire length thereof, opposing claw portions defining the slot and an opening therebetween, the claw portions including a shoulder and a support surface at an acute angle to the shoulder, the transverse distance between the support surfaces of the opposing claws defining a transverse dimension greater than the transverse dimension of said opening defined between the claws, at least one tab portion extending into said slot and aligns with the support surface of one of said claws, and the claws and the tab adapted to engage and support the strip means slidingly engaged by the rod.

12. In a hanger assembly as claimed in claim 11, the rods further comprising a second tab portion positioned in an opposing relation with the first mentioned tab portion, the projected end of said second tab aligning with the support surface of the claw portion on the opposite side of the slot from the first tab portion.

13. In a hanger assembly as claimed in claim 12 wherein the lateral dimension between the opposing tabs conforms to the transverse dimension of the strip means of the assembly and permits the strip means to extend beyond the tab means into the slot in a direction opposite the shoulders.

14. In a hanger assembly as claimed in claim 11, the rods further comprising means for supporting weight means within the internal dimensions of the rod.

15. In a hanger assembly for hanging a sheet of material, the assembly having a plurality of elongated rods, means for hanging one of said rods, strip means for engaging the edge of the sheet of material and for sliding engagement by the rods within a support gap therein, the sheet of material having a series of rectangular holes positioned along at least one edge thereof, the sheet hanging between a first and second rod, the strip means comprising:

a generally elongated portion having a rectangular cross-section, a series of equally spaced projecting portions extending from the elongated portion and having a transverse cross-section forming a generally triangular frustum, a connecting portion integrally formed between the elongated portion and the base of the frustum of the projecting portion, the width of the cross-section of the connecting portion being less than the width of the frustum base, whereby the projecting portions are adapted to project through the holes along the edge of the sheet, elastically deforming the sheet, and the sheet being supported on the connecting portions, and the strip means adapted to conform to the internal dimensions of the support gap in the rod.

16. In a hanging apparatus as claimed in claim 15, the strip means further comprising a projecting tab extending form an angled surface of the projecting porting, said projecting tab adapted to support the sheet prior to engagement of the holes on the connecting portions of the strip.

17. A hanging apparatus for hanging a sheet of material comprising: a plurality of elongated rods; means for suspending one of said rods; strip means for engaging the edge of the sheet of material and for sliding engagement by the rods, the sheet of material hanging between a first and second rod; the rods comprising at least one slot extending longitudinally along the entire length thereof, opposing claw portions defining the slot and an opening therebetween, the claw portions including a shoulder and a support surface at an acute angle to the shoulder, the transverse distance between the support surfaces of the opposing claws defining a transverse dimension greater than the transverse dimension of said opening defined between the claws, at least one tab portion extending into said slot and aligns with the support surface of one of said claws, and the claws and the tab adapted to engage and support the strip means slidingly engaged by the rod; the strip means comprising a generally elongated portion having a rectangular cross-section, a series of equally spaced projecting portions extending from the elongated portion and having a transverse cross-section forming a generally triangular frustum, a connecting portion integrally formed between the elongated portion and the base of the frustum of the projecting portion, the width of the cross-section of the connecting portion being less than the width of the frustum base, whereby the projecting portions are adapted to project through the holes along the edge of the sheet, elastically deforming the sheet, and the sheet being supported on the connecting portions, and the strip means adapted to conform to the internal dimensions of the support gap in the rod.

18. A hanging assembly as claimed in claim 17, wherein the strip means further comprises a projecting tab extending form an angled surface of the projecting porting, said projecting tab adapted to support the sheet prior to engagement of the holes on the connecting portions of the strip.

19. A hanging assembly as claimed in claim 17, wherein the lateral dimension between the opposing tabs of the claw conforms to the transverse dimension of the strip means of the assembly and permits the strip means to extend beyond the tab means into the slot in a direction opposite the shoulders.

20. In a hanger assembly for hanging a sheet of material, the assembly having a plurality of elongated rods, means for hanging one of said rods, an elongated strip means for engaging the edge of the sheet of material and for sliding engagement by the rods within a support gap therein, the sheet of material having a series of rectangular holes positioned along at least one edge thereof, the sheet hanging between a first and second rod, the strip means comprising: a male portion; a female portion; a connecting portion integrally formed between the male and female portions, the male and female portions pivotable about the connecting portion; the male portion having engagement means including a series of spaced projecting points; whereby upon the strip means pivoting about the connecting portion to engage the edge of the sheet, the male portion located on one side of the sheet, the female portion located on the opposite side of the sheet, and the points of the engagement means piercing through the sheet and received by the female portion.

21. In a hanging assembly as claimed in claim 20 wherein the male portion and the female portion have a generally rectangular cross-section when engaging the sheet.

22. In a hanging assembly for hanging a sheet of material, the assembly having a plurality of elongated rods, means for hanging one of said rods, and elongated strip means for engaging the edge of the sheet of material and for sliding engagement by the rods within a support gap therein, the sheet of material having a series of rectangular holes positioned along at least one edge thereof, the sheet hanging between a first and second rod, the strip means comprising: a male portion; a female portion; a connecting portion integrally formed between the male and female portions; the male portion having engagement means including a series of spaced projecting points, the male portion of the strip means including a T-shaped slot having an open gap on one face of the male portion, the engagement means adapted to be received within the T-shaped slot of the male portion such that the points project from the gap, the strip means pivoting about the connecting portion to engage the edge of the sheet, the male portion located on one side of the sheet, the female portion located on the opposite side of the sheet, and the points of the engagement means piercing through the sheet and received by the female portion.

23. In a hanger assembly for hanging a sheet of material, the assembly having a plurality of elongated rods, means for hanging one of said rods, an elongated strip means for engaging the edge of the sheet of material and for sliding engagement by the rods within a support gap therein, the sheet hanging between a first and second rod, the strip means comprising: a first portion; a second portion; a connecting portion integrally formed between the first and second portions; the first portion and the second portion having an adhesive engagement means thereon for engaging opposite sides of the sheet, the first and second portions of the strip means pivotable about the connecting portion to engage the edge of the sheet, such that the first portion is on one side of the sheet and the second portion is on the opposite side of the sheet.

* * * * *